US006093311A

United States Patent [19]

Blum et al.

[11] Patent Number: 6,093,311

[45] Date of Patent: Jul. 25, 2000

[54] $CO_2$ TREATMENT TO REMOVE +2 IONIC METAL FROM CRUDE

[75] Inventors: Saul Blum, Edison; Guido Sartori, Annandale; David W. Savage, Lebanon; Bruce H. Ballinger, Bloomsbury, all of N.J.

[73] Assignee: Exxon Research and Engineering Co, Florham Park, N.J.

[21] Appl. No.: 09/307,385

[22] Filed: May 7, 1999

Related U.S. Application Data

[63] Continuation of application No. 08/961,816, Oct. 31, 1997, abandoned, which is a continuation of application No. 08/726,014, Oct. 14, 1996, abandoned.

[51] Int. Cl.[7] ..... C10G 29/02

[52] U.S. Cl. ..... 208/251 R

[58] Field of Search ..... 208/251 R

[56] References Cited

U.S. PATENT DOCUMENTS

| | | | |
|---|---|---|---|
| 4,191,639 | 3/1980 | Audeh et al. | 208/309 |
| 4,228,022 | 10/1980 | Lowe et al. | 252/42.7 |
| 4,464,251 | 8/1984 | Kukes et al. | 208/221 |
| 4,465,589 | 8/1984 | Kukes et al. | 208/208 R |
| 4,518,489 | 5/1985 | Hitzman | 208/223 |

OTHER PUBLICATIONS

"Chemical Refining of Petroleum" by Kalichevsky et al., 1942, pp. 30–35 and 166–167.

*Primary Examiner*—Walter D. Griffin
*Assistant Examiner*—Nadine Preisch
*Attorney, Agent, or Firm*—Ronald D. Hantman

[57] ABSTRACT

The present invention is a process to remove a +2 ionic charged metal from a petroleum feed. The process includes contacting feed with carbon dioxide at a temperature between 40° C. and 200° C. and autogenous pressure. In a preferred embodiment the metal is a Group II metal. In particular, the metal is calcium.

10 Claims, No Drawings

$CO_2$ TREATMENT TO REMOVE +2 IONIC METAL FROM CRUDE

This is a continuation of application Ser. No. 08/961,816 filed Oct. 31, 1997, now abandoned which is a continuation of Ser. No. 08/726,014 filed Oct. 14, 1996, now abandoned.

BACKGROUND OF THE INVENTION

The present invention relates to a process to remove certain metals from crude oil. In particular, the metal is calcium.

Calcium present in crudes can lead to fouling of heaters and heat exchangers and poison catalysts used in crude processing. Therefore, Ca-rich crudes are less valuable than crudes with low Ca. A process for Ca removal enables the increase of the value of such crudes. This invention is particularly valuable when a Ca-rich crude is processed in a corrosion-resistant environment, where the increase in acidity accompanying the process of the present invention is not a drawback.

Some patent and published literature exists, dealing with metals removal from petroleum. One approach did not use carbon dioxide, instead contacting the petroleum with aqueous solutions of acids to effect metals removal as follows: Reynolds (U.S. Pat. No. 4,778,591) described a process for removing metals from petroleum using aqueous carbonic acids. In U.S. Pat. No. 4,853,109 Reynolds used aqueous dibasic carboxylic acids to remove metals from petroleum. Kramer et al. (U.S. Pat. No. 4,988,433) taught the removal of metals from petroleum using an aqueous monobasic carboxylic acid or its salt. In the other approach, Eckerman et al. (Chem. Eng. Technol. (1990), 13(4), 258–64) and Funk (Am. Chem. Soc. Div. Fuel Chem., (1985) 30(3), 148, 148*a*, 149, 149*a*, 150–3) reported on the use of supercritical $CO_2$ fluid to deasphaltene heavy oils accompanied by some removal of only porphyrin metals (Ni, V) associated with the asphaltenes. This form of $CO_2$ has different properties and different separation selectivity from the present invention.

SUMMARY OF THE INVENTION

The present invention is a process to remove a +2 ionic charged metal from a petroleum feed. The process includes contacting feed with carbon dioxide at a temperature between 40° C. and 200° C. and autogenous pressure. In a preferred embodiment the metal is a Group II metal. In particular, the metal is calcium.

DESCRIPTION OF THE PREFERRED EMBODIMENT

The present invention is a process to remove +2 ionic charged metals from a petroleum feed. The metals include Ca, Mg, Mn, and Zn. Calcium is particularly important. The process includes contacting the feed with carbon dioxide. These metals may be in several forms, including naphthenates, phenolates, chlorides or sulfates.

The reaction is carried out in any suitable pressure reactor, e.g. an autoclave under autogenous pressure. The temperature should be high enough to permit easy stirring of the crude. The reaction probably occurs as follows:

$$Ca^{++}+CO_2+H_2O \rightarrow 2H^{+}+CaCO_3 \downarrow$$

The following examples illustrate the invention.

EXAMPLE 1

The reaction apparatus was an autoclave with a capacity of 250 ml. 100 g of Kome 6/1 crude, containing 930 ppm of Ca, 2 ppm of Mg, 42 ppm of Mn and 2.6 ppm of Zn were put into the autoclave. 9.9 g of solid $CO_2$ (dry ice) was added, then the autoclave was sealed quickly and slowly brought to 80° C., where it was kept for 3 hours.

After cooling, excess $CO_2$ was vented, the autoclave was opened and solids were separated from the oil by centrifugation. The oil was analyzed and found to contain 222 ppm of Ca, 1.1 ppm of Mg, 10.6 ppm of Mn and 1.3 ppm of Zn, i.e. considerably less than in the untreated crude.

The oil was heated at 100° C. for 8 hours to desorb $CO_2$. Infrared examination showed that the band at 1708 $cm^{-1}$, corresponding to the carboxyl group, was more intense than in untreated Kome 6/1, whereas the broad band around 1580 $cm^{-1}$, corresponding to the carboxylate, was less intense than in untreated Kome 6/1.

The solid separated by centrifugation was washed repeatedly with toluene to remove crude sticking to it. After each washing, the solid was separated by centrifugation. Finally, the solid was dried in vacuo. X-ray diffraction analysis showed peaks at 2θ values of 23.2, 26.7, 29.55, 31.65, 36.15, 39.6, 43.35, 47.25, 47.7, 56.8, 57.65 and 59.75 degrees, also present in the spectrum of an authentic sample of calcium carbonate (calcite).

EXAMPLE 2

The reaction apparatus was the same as in Example 1. The same conditions were used as in Example 1, except that the reaction time was 24 hours. After separation of the solids by centrifugation, the treated crude contained 256 ppm of Ca, 0.9 ppm of Mg, 11.9 ppm of Mn and 0.9 ppm of Zn, i.e. much less than the starting Kome 6/1.

EXAMPLE 3

Example 2 was repeated under identical conditions. After separation of the solids by centrifugation, the treated crude contained 187 ppm of Ca, 8.8 ppm of Mn and 0.9 ppm of Zn, i.e. much less than the starting Kome 6/1.

The solid separated by centrifugation was freed of crude by repeatedly washing with toluene, as described in Example 1. Then the solid was dried in vacuo. X-ray examination showed the same peaks as described in Example 1, also present in the spectrum of authentic calcium carbonate (calcite).

EXAMPLE 4

An artificial mixture was prepared from 97.5 g of a visbreaker fraction and 2.5 g of a solution of Ca naphthenates in mineral spirits, containing 4 weight % Ca. The artificial mixture contained 1000 ppm of Ca. The artificial mixture was put into an autoclave, to which 11 g of solid $CO_2$ was added. Then the autoclave was closed, heated to 80° C. and kept there for 24 hours.

After cooling, the solid was separated by centrifugation.

The oil was submitted to elemental analysis and found to contain 387 ppm of Ca, i.e. the Ca concentration had decreased to less than 40% of the original.

The solid separated by centrifugation was washed with toluene to free it of oil, dried in vacuo and submitted to X-ray analysis. It consisted essentially of $CaCO_3$, i.e. it showed the same peaks as described in Example 1, also present in the spectrum of authentic $CaCO_3$ (calcite).

What is claimed is:

1. A process to remove a +2 ionic charged metal from the organic phase of a petroleum feed comprising (a) contacting said feed with a reagent whose sole active ingredient is carbon dioxide to form an insoluble reaction product which selectively removes a +2 ionic charged metal at a temperature between 40° C. and 200° C. and autogenous pressure, and (b) removing said insoluble reaction product containing said +2 ionic charged metal from said organic feed.

2. The process of claim 1 wherein said metal is a Group II metal.

3. The process of claim 2 wherein said metal is calcium.

4. The process of claim 1 wherein said metal is Mg.

5. The process of claim 1 wherein said metal is Mn.

6. The process of claim 1 wherein said metal is Zn.

7. The process of claim 1 wherein said charged metal is in the form of naphthenates.

8. The process of claim 1 wherein said charged metal is in the form of phenolates.

9. The process of claim 1 wherein said charged metal is in the form of chlorides.

10. The process of claim 1 wherein said charged metal is in the form of sulfates.

* * * * *